US009700138B2

(12) United States Patent
Rechtien et al.

(10) Patent No.: US 9,700,138 B2
(45) Date of Patent: Jul. 11, 2017

(54) SEATING FURNITURE PRODUCT

(71) Applicant: Wilkhahn Wilkening + Hahne GmbH + Co., Bad Münder (DE)

(72) Inventors: Andreas Rechtien, Porta Westfalica (DE); Detlef Trutwig, Lauenau (DE); Carsten Gehner, Hannover (DE)

(73) Assignee: Wilkhahn Wilkening + Hahne GmbH + Co. (DE)

( * ) Notice: Subject to any disclaimer, the term of this patent is extended or adjusted under 35 U.S.C. 154(b) by 0 days.

(21) Appl. No.: 15/042,336

(22) Filed: Feb. 12, 2016

(65) Prior Publication Data

US 2016/0235203 A1 Aug. 18, 2016

(30) Foreign Application Priority Data

Feb. 12, 2015 (DE) ..... 10 2015 102 007

(51) Int. Cl.

| | |
|---|---|
| ***A47C 3/00*** | (2006.01) |
| ***A47C 3/026*** | (2006.01) |
| ***A47C 1/024*** | (2006.01) |
| ***A47C 1/032*** | (2006.01) |

(52) U.S. Cl.

CPC ..... *A47C 1/024* (2013.01); *A47C 1/032* (2013.01); *A47C 1/03255* (2013.01)

(58) Field of Classification Search

CPC .... A47C 1/024; A47C 1/0232; A47C 1/03255
USPC ..... 297/285, 296, 297, 298, 354.11, 316, 297/325, 326, 327, 328, 302.1, 300.1, 297/300.2

See application file for complete search history.

(56) References Cited

U.S. PATENT DOCUMENTS

| | | | | | |
|---|---|---|---|---|---|
| 2,538,507 | A * | 1/1951 | Cramer | A47C 7/441 | 297/301.4 |
| 3,712,666 | A * | 1/1973 | Stoll | A47C 1/036 | 297/313 |
| 3,756,654 | A * | 9/1973 | Bauer | A47C 3/026 | 297/301.1 |
| 3,902,754 | A * | 9/1975 | Braeuning | A47C 5/06 | 297/328 |
| 4,143,910 | A * | 3/1979 | Geffers | A47C 1/03283 | 297/300.3 |
| 4,560,199 | A * | 12/1985 | Sapper | A47C 1/03255 | 297/300.1 |

(Continued)

FOREIGN PATENT DOCUMENTS

| | | | | |
|---|---|---|---|---|
| DE | 102011105290 A1 * | 12/2011 | ..... | A47C 1/03255 |
| NO | EP 2100539 A1 * | 9/2009 | ..... | A47C 1/03255 |

*Primary Examiner* — Rodney B White

(74) *Attorney, Agent, or Firm* — Renner Kenner Grieve Bobak Taylor & Weber

(57) ABSTRACT

A seating furniture product, with a support surface unit which forms a seat part and a backrest connected directly to the seat part, and with a frame, wherein the seat part is connected to the frame by means of a swivel joint allowing a rotation about a swivel axis aligned transversely to the seating furniture product and the backrest is connected to the frame by a fastening point, is characterized in that the distance between the fastening point and the swivel joint can be changed in terms of the vertical direction of the seating furniture product, such that changing this distance is accompanied by a change in the inclination alignment of the seat part.

17 Claims, 4 Drawing Sheets

(56) References Cited

U.S. PATENT DOCUMENTS 4,685,730 A * 8/1987 Linguanotto ..... A47C 1/03216 297/316
4,685,733 A * 8/1987 Machate ..... A47C 7/46 297/284.4
4,834,453 A * 5/1989 Makiol ..... A47C 1/03255 297/354.11 X
5,150,948 A * 9/1992 Volkle ..... A47C 1/03255 297/300.5
5,249,839 A * 10/1993 Faiks ..... A47C 1/03255 297/284.4
5,354,120 A * 10/1994 Volkle ..... A47C 1/03255 297/300.1
5,425,566 A * 6/1995 Buchacz ..... A47C 1/03255 297/300.3
5,556,163 A * 9/1996 Rogers, III ..... A47C 1/023 297/330
6,478,379 B1 * 11/2002 Ambasz ..... A47C 7/024 297/354.11 X
6,523,898 B1 * 2/2003 Ball ..... A47C 1/023 297/284.4
7,000,987 B2 * 2/2006 Staarink ..... A47C 7/46 297/354.11 X
7,475,943 B1 * 1/2009 Huang ..... A47C 7/405 297/354.11 X
7,857,389 B2 * 12/2010 Ueda ..... A47C 1/03255 297/296
8,602,496 B2 * 12/2013 Lu ..... A47C 7/448 297/285
8,752,896 B2 * 6/2014 Takeuchi ..... A47C 1/03 297/300.1
9,131,775 B1 * 9/2015 Eisenberg ..... A47C 7/14
9,138,061 B1 * 9/2015 Eisenberg ..... A47C 1/023
2003/0071502 A1 * 4/2003 Marshall ..... A47C 1/03255 297/302.1
2003/0173808 A1 * 9/2003 Ruckstadter ..... A47C 1/03294 297/320
2012/0256458 A1 10/2012 Gehner
2014/0103688 A1 * 4/2014 Wilson ..... A47C 1/03211 297/284.7
2015/0091353 A1 * 4/2015 Horn ..... A47C 1/032 297/354.11
2015/0265052 A1 * 9/2015 Gehner ..... A47C 7/14 297/316

* cited by examiner

SEATING FURNITURE PRODUCT

TECHNICAL FIELD

The invention concerns a seating furniture product with a support surface unit, which forms a seat part and a backrest connected directly to the seat part, and with a frame, wherein the seat part is connected to the frame by means of a swivel joint allowing a rotation about a swivel axis aligned transversely to the seating furniture product and the backrest is connected to the frame by a fastening point.

BACKGROUND OF THE INVENTION

A seating furniture product of this type in the form of a chair is known from DE 10 2011 001 811 A1. In this case, by applying pressure on the backrest, a user is able to move the chair starting from a basic setting, with the seat part virtually horizontal and the backrest approximately vertically aligned, to a reclining attitude in which not only the backrest is arranged at a greater angle to the vertical, but, simultaneously, the seat part also is arranged at a greater angle in relation to the horizontal. By leaning back, the user causes the inclination angle of the seat part to change dynamically due to an active movement of the user on the chair. The chair known from DE 10 2011 001 811 A1 does not offer the possibility of changing the inclination angle of the seat part statically, independent of the dynamic change in inclination angle.

With this prior art as the starting point, the invention is based on the task of demonstrating how a category of seating furniture, as known from DE 10 2011 001 811 A1, can be extended by providing the ability to adjust the inclination of the seat part incorporated in a most advantageous manner.

SUMMARY OF THE INVENTION

This task is resolved by a seating furniture product according to patent claim 1. Advantageous embodiments of this form the subject matter of the other patent claims and emerge from the following description of the invention.

The invention concerns a seating furniture product consisting of a support surface unit which forms a seat part and a backrest connected directly to the seat part, and with a frame, wherein the seat part is connected to the frame by means of a swivel joint allowing a rotation about a swivel axis directed transversely to the seating furniture product and the backrest is connected to the frame by a fastening point, characterised in that the distance between the fastening point and the swivel joint can be changed in terms of the vertical direction of the seating furniture product, such that changing this distance is accompanied by a change in the inclination alignment of the seat part.

"Transverse direction" of the seating furniture product, as it relates to the invention, is understood to mean any direction which extends from one side of the seating furniture product (in particular a projection of the seating furniture product in a vertically aligned plane arranged alongside this side of the seating furniture product) towards the other side of the seating furniture product (in particular a projection of the seating furniture product in a vertically aligned plane arranged alongside this other side of the seating furniture product). In a corresponding manner, "vertical direction" of the seating furniture product is understood to mean any direction which extends from an underside of the seating furniture product (in particular a projection of the seating furniture product in a horizontally aligned plane arranged underneath the seating furniture product) towards an upper side of the seating furniture product (in particular a projection of the seating furniture product in a horizontally aligned plane arranged above the seating furniture product). Preferably in this case, it involves that direction which defines the shortest distance between the two described projections of the seating furniture product.

A "direct" connection between the seat part and the backrest is then created when the support surface unit, insofar as it was separated from the frame, constitutes a continuous and possibly rigidly continuous unit (with the exception of relative movements amounting to a deformation). A connection between the seat part and the backrest does not have to be made exclusively by means of the frame. The support surface unit can be formed advantageously in the form of an integral seat shell wherein the seat part and the backrest transition directly into each other. An integral seat shell of this type can be formed advantageously also in one piece or can comprise at least a one-piece seat shell base. Equally it is possible to form the seat part and the backrest of the support surface unit as separate components which are joined together by one or a multiplicity of fastening elements of the support surface unit.

The embodiment according to the invention of a seating furniture product makes it possible to incorporate (static) inclination adjustability into the seat part of the support surface unit with a particularly advantageous design since, basically, it is simply necessary to be able to move the fastening point, by means of which the backrest is connected to the frame, in the vertical direction of the seating furniture product.

According to the invention it is not necessary that changing the distance of the swivel joint from the fastening point over the entire length in which this is possible constitutes a change in the inclination alignment of the seat part. Instead, it is sufficient if this is possible in at least a section of this longitudinal range.

In a preferred embodiment of the inventive seating furniture product, provision can be made that the fastening point can be fixed in position at different distances from the swivel joint. By doing so, it is possible to set defined inclination alignments of the seat part in the basic setting of the seating furniture product, so that a user of the seating furniture product is able to select the best possible alignment of the seat part for him/herself. In this case, the different distances at which the fastening point can be fixed in position in relation to the swivel joint can be selected either at predetermined or continuously variable settings.

In another preferred embodiment inventive seating furniture product, provision can be made that the frame comprises a backrest base support and a slide forming the fastening point with the backrest wherein said slide is movable along the backrest base support. This can constitute an advantageously designed and/or easily manageable method of changing the distance of the fastening point from the swivel joint in terms of the vertical direction of the seating furniture product. In a specific embodiment of a seating furniture product of this type, a backrest support comprising the backrest base support and the slide advantageously can be of a telescopic design.

Advantageously also, in this case a locking mechanism can be provided to lock the movement of the slide in at least one locking position preventing the fastening point approaching the swivel joint, wherein it is possible to unlock this action. A locking mechanism of this type prevents the undesired misalignment of the (static) inclination adjustment according to the invention of the seat part due to stress placed on the seat part by the bodily weight of a user, while at the same time allowing readjustment by the application of a tensile force acting in the vertical direction.

In a further preferred manner, provision can be made that unlocking can be performed also by moving the slide to a release position wherein the fastening point is a maximum distance from the swivel joint. After unlocking, the distance of the fastening point from the swivel joint can be reduced again, in particular to a basic inclination setting in which this distance (a function of the adjustability) is minimal. An embodiment of an inventive seating furniture product of this type makes it particularly easy for a user to operate the (static) inclination adjustment of the seat part. An embodiment of the locking mechanism is also possible such that the distance of the fastening point from the swivel joint can be reduced after unlocking in each of the predetermined locking positions.

Furthermore, an embodiment of the locking mechanism is possible wherein, in the at least one locking position, it also locks a movement which would increase the distance of the fastening point from the swivel joint. In this case, it may also be necessary to release the locking to make an adjustment by the application of a tensile force acting in the vertical direction.

In a further preferred manner, provision can be made that a spring element is applied to the slide in at least one movement direction. In this case, it is particularly possible to provide that a force is applied to the slide in the direction of an increasing distance between the fastening point and the swivel joint. In the case of an inventive embodiment of this type of the seating furniture product, possibly after releasing the locking, it is possible to achieve a situation in which the distance between the fastening point and the swivel joint in terms of the vertical direction of the seating furniture product changes automatically due to the force applied by the spring element. Also it is possible that, as the force is being applied by the spring element, there is at least a partial counteraction by the weight of the support surface unit so that, for example, there may be resistance to the automatic inclination adjustment when the locking is released. Therefore, the force applied by the spring element can compensate (in particular as precisely as possible) the action of the weight of the support surface unit. Thus, provision can be made that adjusting the inclination alignment of the seat part has to be effected actively in both directions while correspondingly a force is applied to the support surface unit. This may also make it easier for a user to operate the seating furniture product.

In a further preferred embodiment of the inventive seating furniture product, provision can also be made wherein the seat part has a saddle part which can swivel in relation to a base element of the seat part about a pivot axis aligned in a transverse direction of the seating furniture product (and advantageously can also be fixed in at least one defined swivel position and can bear a load therefore). The saddle part, which can be of any shape, can thereby serve, particularly at relatively large inclination angles of the base element of the seat part, as an additional or alternative seating surface for a user, providing the inventive seating furniture product with versatility in the way it can be used. For example, the saddle part may enable the inventive seating furniture product to be used to provide comfort as a standing seat. This type of standing seat is characterised in that a user does not support his/her entire weight on the seat part, but instead, standing on the ground, is supported from the back on the seat part and specifically on the saddle part. In this case, the angle enclosed at any time between the user's upper and lower legs is greater than 90° and in particular is at least 130°.

In this type of embodiment of the inventive seating furniture product, a mechanism may advantageously be provided by means of which the angle between the base element and the saddle part is increased as the distance of the fastening point from the swivel joint increases. The pivoting of the saddle part relative to the base element of the seat part is coupled thereby to a change in the distance between the fastening point and the swivel joint in terms of the vertical direction of the seating furniture product. In a particularly preferred manner in this case, provision can be made that the saddle part is always maintained in alignment by the action of the mechanism (advantageously approximately horizontal). However, it is also possible to provide the saddle part with the ability to swivel relative to the seat part.

It is not necessary that changing the distance of the swivel joint from the fastening point over the entire length in which this is possible constitutes a change in a pivot angle between the base element and the saddle part. Instead, it is sufficient if this is possible in at least a section of this longitudinal range. Thus, for example, provision can be made that an increase in the distance of the fastening point from the swivel joint starting from a base inclination setting in a first section of this change in distance is unaffected by a pivot angle between the base element and the saddle part (which can, in particular, also be zero so that the saddle part is located inside the base element), while only a change in distance which follows in a second section leads to an increase in the pivot angle.

A particularly simple design for an embodiment for the mechanism swivelling the saddle part relative to the base element of the seat part can be realised if a (in particular rigid) transmission element is provided which interacts, on the one hand, with the saddle part at a position at a distance from the pivot axis (i.e. at least supports the latter) and is possibly connected to the latter (movably), and, on the other hand, is coupled with the fastening point (directly or indirectly).

In a preferred embodiment of the inventive seating furniture product, provision can be made that the fastening point comprises a swivel joint allowing rotation about a swivel axis aligned in a transverse direction of the seating furniture product or is formed by a swivel joint of this type. Advantageously, this embodiment makes it possible to incorporate a function which inclines the backrest backwards and (in combination with the swivel joint connecting the seat part to the frame) as well as the entire support surface unit.

The mobility of the support surface unit can also be improved by designing the support surface unit to be able to twist in torsion and for the fastening point to comprise a swivel joint allowing rotation about a swivel axis aligned in a longitudinal direction of the seating furniture product or is formed by a swivel joint of this type. Advantageously, the seat part can also be connected to the frame by a swivel joint allowing rotation about a swivel axis aligned in the vertical direction of the seating furniture product. This type of embodiment of the seating furniture product enables a user of the seating furniture product to be supported advantageously, in particular since the backrest is able, at least partially, to follow the back of the user as it moves sideways.

The term "longitudinal direction" of the seating furniture product is understood, in connection with the invention, as meaning that direction which extends from a rear side of the seating furniture product (in particular a projection of the seating furniture product in a vertically aligned plane arranged behind the seating furniture product) towards a front side of the chair (in particular a projection of the seating furniture product in a plane vertically aligned on the front side of the seating furniture product). Advantageously in this case, it concerns the particular direction which defines the shortest distance between the two described projections of the seating furniture product.

The support surface unit can be provided with a high degree of mobility with a particularly simple design by arranging the fastening point centrally in relation to the transverse direction of the backrest.

A particularly advantageous function which inclines the backrest backwards can be incorporated into the inventive seating furniture product wherein the frame has a seat base connected to the seat part by the swivel joint and a backrest support connected to the backrest by the fastening point, wherein the seat base and the backrest support are connected by a swivel joint allowing rotation about a swivel axis aligned transversely to the seating furniture product. In this way it is possible in particular to achieve a situation wherein the backrest support is adjustable in relation to the seat base between a first upright attitude and a second, backward leaning attitude, wherein an angle between the seat part and the backrest in the second attitude is greater than in the first attitude. A change of this type between the angle formed the seat part and the backrest as part of a backward leaning function of the seating furniture product is regarded by many user as comfortable.

The same applies to another preferred embodiment of the inventive seating furniture product in which provision is made that the backrest support is adjustable in relation to the seat base between a first upright attitude and a second, backward leaning attitude, wherein a readjustment between the two attitudes causes a front edge of the seat part to move in the vertical direction of the seating furniture product.

Again, in order to improve the comfort in using the chair, it can be designed advantageously as a swivel chair in which a seat base of the frame is connected to a foot part of the frame by a swivel joint allowing rotation about a swivel axis aligned in the vertical direction of the seating furniture product.

The indefinite article "a", in particular in the patent claims and in the description generally explaining the patent claims, is to be understood as such and not as numerals. Correspondingly, therefore, specified components are to be understood such that they can be present singly at a minimum and can be present in multiples.

BRIEF DESCRIPTION OF THE DRAWINGS

The invention is explained in more detail below with the aid of embodiment examples illustrated in the drawings. Each of the drawings shows diagrammatically.

DETAILED DESCRIPTION OF ILLUSTRATIVE EMBODIMENTS

Figure 2:
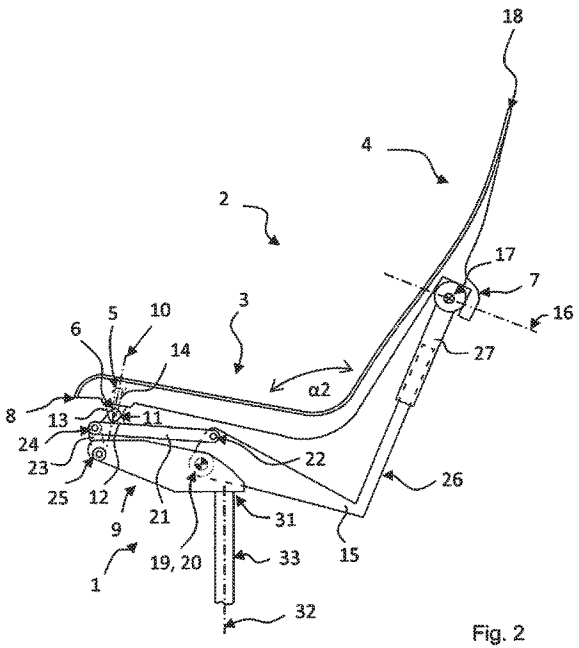
FIG. 2: a side view of the seating furniture product as in FIG. 1 in a backwards inclined attitude and with the first inclination attitude of the seat part.

The seating furniture product illustrated in FIGS. 1 to 4 in form of a chair comprises a frame 1 and a support surface unit connected to the frame 1, said support surface unit being formed as seat shell 2.

The frame 1 is made to be essentially rigid. Thus, it is designed such that the individual elements forming (supporting) the frame are not intended to deform when used in a proper manner.

The seat shell 2 is formed integrally so that a section used as seat part 3 merges into a section of the seat shell 2 used as backrest 4. In this case, the seat shell 2 can be formed in one or in multiple pieces (then in particular advantageously with a one-piece upper seat shell part and a frame supporting the upper seat shell part).

The seat shell 2 is connected to the frame 1 by three swivel joints 5, 6, 7. Here, a first swivel joint 5 is arranged in the vicinity of the seat front edge 8 of the seat shell 2. As regards the transverse direction of the chair, the first swivel joint 5 is positioned centrally and therefore practically in the sagittal plane of a user of the chair. The first swivel joint 5 allows rotation of the section of the seat shell 2, specifically essentially of the entire seat part 3, connected to this swivel joint 5, relative to the corresponding section of the frame 1 (of the seat base 9) about a first swivel axis 10. The first swivel axis 10 runs in the vertical direction of the chair. Specifically, it is aligned approximately vertically (with the chair standing on level ground). The second swivel joint 6 comprises two partial swivel joints (an embodiment is also possible with an advantageously continuous swivel joint), which are separated from each other in relation to the transverse direction of the chair and, therefore, each being approximately the same distance from the first swivel joint 5. The two partial swivel joints together define a second swivel axis 11, which runs transversely to the chair and specifically approximately parallel to the front seat edge 8 of the seat part 3 (alternatively, in the case of a curved front seat edge 8, parallel to the straight lines connecting both ends of the front seat edge 8). In addition, in each case a bearing pedestal 12 of each partial swivel joint is connected to the frame 1 of the chair, while a common bearing bridge 13 serves as a support for the seat part 3 of the seat shell 2 and incorporates a swivel bearing pin 14 of the first swivel joint 5. The seat part 3 of the seat shell 2, guided by the first swivel joint 5, is therefore mounted to rotate on the bearing bridge 13 of the second swivel joint 6.

The third swivel joint 7 connects the seat shell 2 in the area of the backrest 4 to a backrest support 15 of the frame 1. In doing so, the third swivel joint 7 is arranged centrally in relation to the transverse direction of the chair and, therefore—just as with the first swivel joint 5—practically in the sagittal plane of a user of the chair. The third swivel joint 7 is formed as a ball joint. As a result, it allows rotation of the backrest 4 relative to the backrest support 15 about a number of axes, amongst others, about at least one third swivel axis 16 running longitudinally to the chair as well as a fourth swivel axis 17 running transversely to the chair.

The mounting of the seat shell 2 according to the invention allows the seat shell 2 to deform as the weight of a user shifts, wherein said seat shell is moved, in the transition from the seat part 3 to the backrest 4, to one side while the front seat edge 7 and a backrest edge 18 are pivoted towards the other side.

Figure 1:
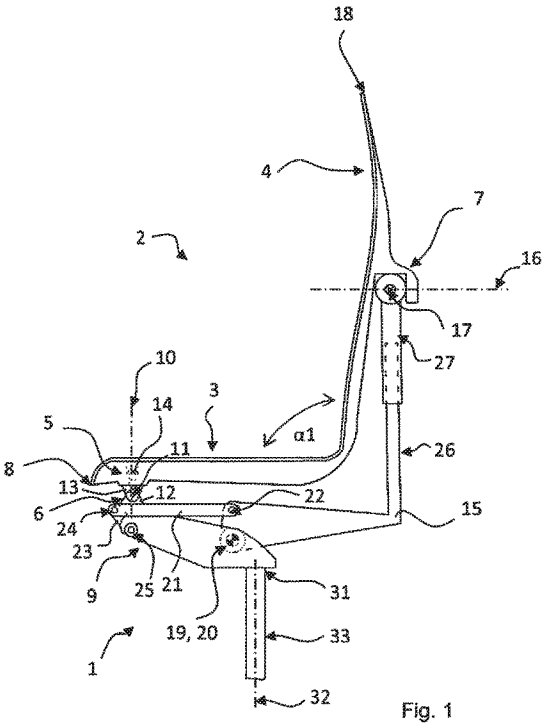
FIG. 1: a side view of an embodiment of an inventive seating furniture product in an upright attitude and with a first inclination attitude of the seat part.
Figure 4:
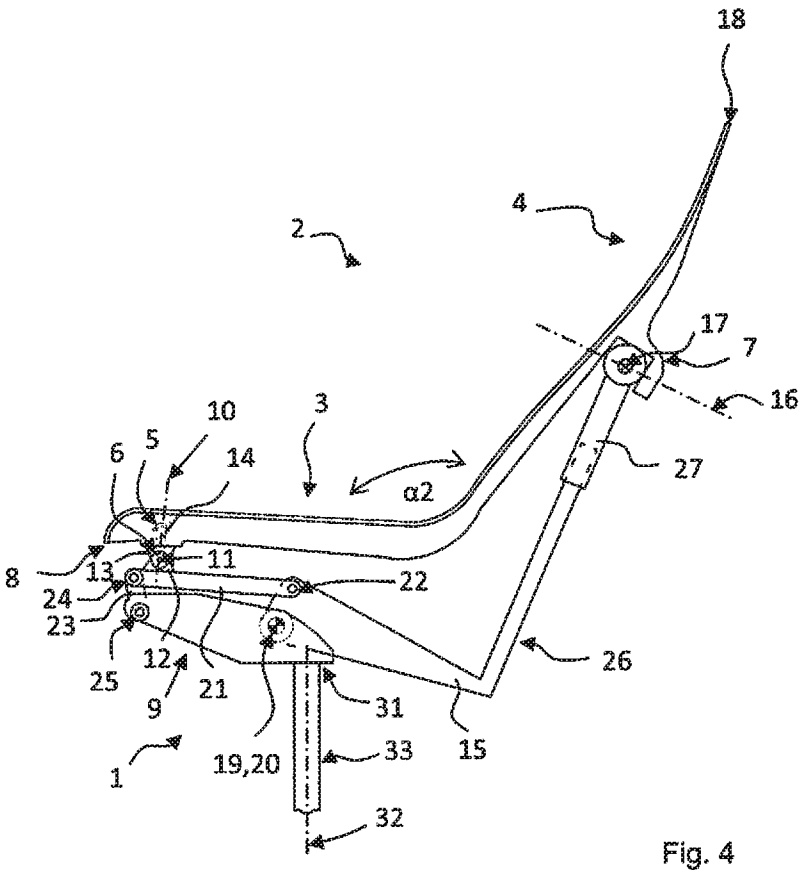
FIG. 4: a side view of the seating furniture product as in FIGS. 1 to 3 in a backwards inclined attitude and with the second inclination attitude of the seat part.
Figure 3:
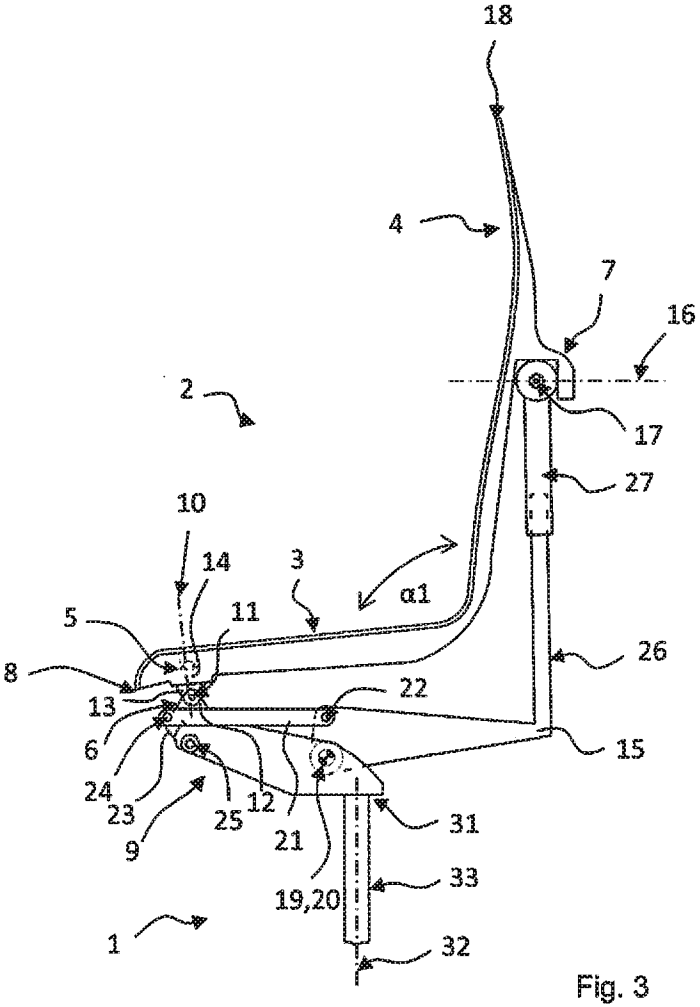
FIG. 3: a side view of the seating furniture product as in FIGS. 1 and 2 in an upright attitude and with a second inclination attitude of the seat part.
Figure 6:
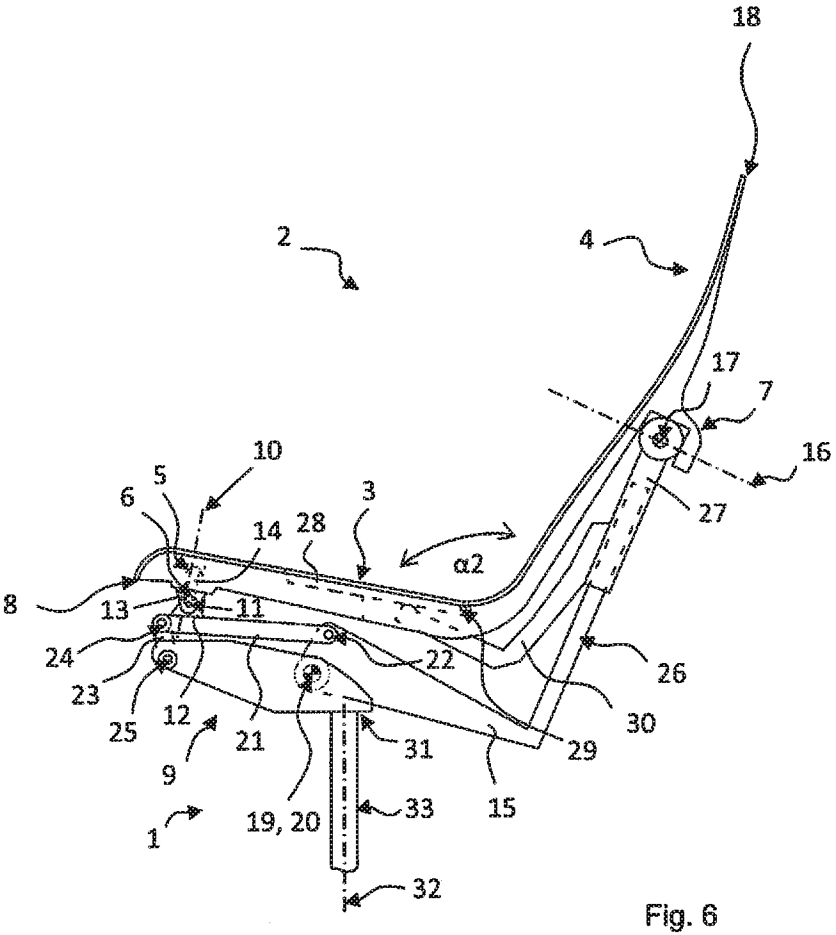
FIG. 6: a side view of the seating furniture product as in FIG. 5 in a backwards inclined attitude and with the first inclination attitude of the seat part.
Figure 5:
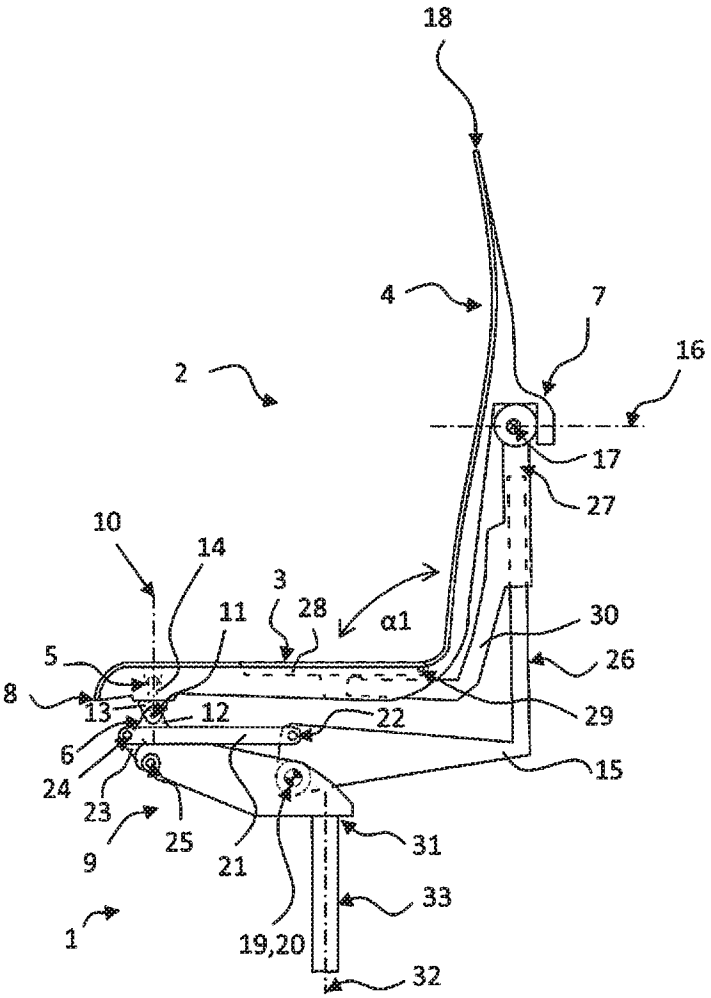
FIG. 5: a side view of a second embodiment of an inventive seating furniture product in an upright attitude and with a first inclination attitude of the seat part.
Figure 8:
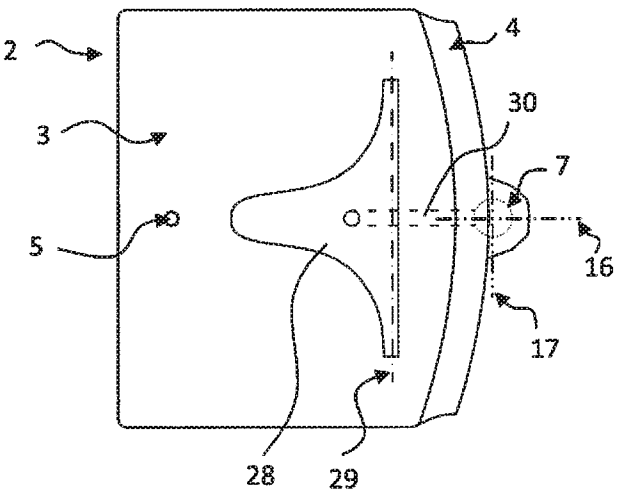
FIG. 8: a top view of the seating furniture product as in FIG. 7.
Figure 7:
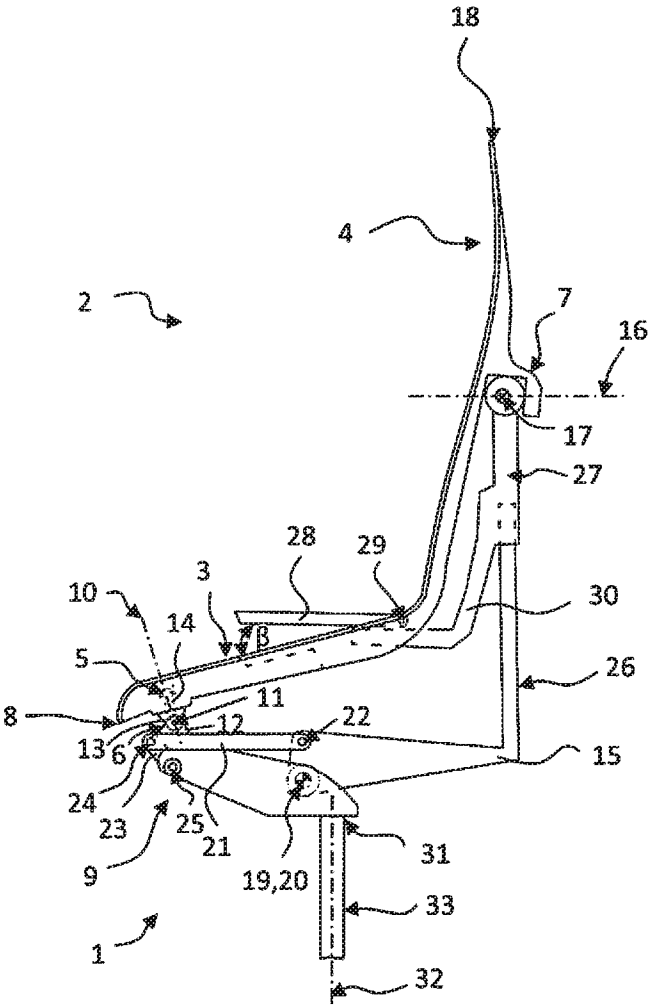
FIG. 7: a side view of the seating furniture product as in FIGS. 5 and 6 in an upright attitude and with a second inclination attitude of the seat part of this embodiment.

The backrest support 15 of the frame 1 is formed so that it is structurally separate from the seat base 9 of the frame 1 and is connected to the seat base 9 by a fourth swivel joint 19 to rotate about a fifth swivel axis 20, also extending transversely to the chair. By allowing the backrest support 15 to rotate in relation to the seat base 9, the chair gains a function which inclines the backrest backwards which allows a user to lean backwards aided by the chair, which is shown by comparing FIGS. 1 and 2 in relation to FIGS. 3 and 4. The backward inclination of the seat shell 2 causes the tension in a spring element (not visible) to increase so that, when the pressure on the backrest is removed, it is restored back to the basic setting again automatically, as illustrated in FIGS. 1 and 3.

Due to the distance of the fifth swivel axis 20 from the second swivel axis 11 formed by the second swivel joint 6 and extending transversely to the chair, an angle $\alpha$ ($\alpha_1<\alpha_2$) formed between the seat part 3 and the backrest 4 increases when the seat shell 2 is inclined backwards.

Furthermore, the chair incorporates a kinematic system which ensures that inclining the seat shell 2 backwards is accompanied by lifting (movement in the vertical direction) the first and second swivel joints 5, 6 and, therefore, the front seat edge 8. To do this, the fourth swivel joint 19, by means of which the backrest support 15 is connected to the seat base 9, is arranged with a gap from the second swivel axis 11. Furthermore, two (one each on each side of the backrest support 15) rods 21 (an embodiment with one rod 21 can suffice) are connected, and able to rotate about a (common) sixth swivel axis 22, directed transversely to the chair, to the backrest support 15 at the end of the backrest support 15 on which the fourth swivel joint 19 is arranged also. Here, the sixth swivel axis 22 is arranged with a gap from the fifth swivel axis 20 formed by the fourth swivel bearing 19. The rods 22 each extend respectively to one end of a lever 23, to which they are connected to rotate about a seventh (common) swivel axis 24 extending transversely to the chair. Each other end of the lever 23 is connected with the seat base 9 to rotate about an eighth (common) swivel axis extending transversely to the chair. This therefore produces a gap between the seventh swivel axis 24 and the eighth swivel axis 25. The bearing pedestals 12 of the second swivel joints 6 are connected by a transverse support to the two rods 21 in the vicinity of the seventh swivel axis 24. By attaching the second swivel joint 6 to the frame 1, it is possible to adjust the height as desired, coupled to the backward inclination of the seat shell 2, of the first and second swivel bearings 5, 6 and thus of the front seat edge 8.

The section of the L-shaped (alternative: bow-shaped) backrest support 15 running in the vertical direction of the chair is formed telescopically and also comprises a backrest support 26 connected to the seat base 9 and a tubular slide 27 incorporating the third swivel joint 7, wherein said slide is guided to slide on the corresponding end of the backrest support 26, wherein the positioning of the slide 27 on the backrest support 26 can also be locked in different locking positions.

As can be seen in particular by comparing FIGS. 1 and 3, a change in length of the section of the backrest support 15 running in a vertical direction by telescopically moving the slide 27 on the backrest support 26 causes a change in the inclination alignment of the seat part 3 due to an increasing, or, as the case may be, decreasing distance of the fastening point formed by the third swivel joint 7 between the backrest support 15 (and therefore the frame 1) and the backrest 4 of the seat shell 2. In this manner, the static inclination alignment of the seat part 3 can be adapted to the individual wish of a user. This is independent of a dynamic change in inclination which arises in conjunction with the functional ability of the chair to incline backwards.

In order to be able to set different fixed inclination alignments, a locking mechanism (not shown in detail) is incorporated in the backrest support 4, wherein said locking mechanism is formed, for example, such that, when the slide 27 is raised manually, it passes over different consecutive latching positions each of which provides a lock against the movement of the slide 27 on the backrest support 26 causing a shortening of the section of the backrest support 15 aligned vertically, so that a selected inclination alignment of the seat part 3 corresponding to one of the locking positions is assured, even if pressure is being applied to the seat shell 2 by a user sitting on it. The locking action of the locking mechanism can be formed so that it can be released wherein the slide 27 is moved in the furthest possible position traveled and, therefore, defining the greatest possible distance from the second swivel axis 11. The telescopic section of the backrest support 15 extending vertically can be pushed in again completely and optionally pulled out again to achieve a new desired locking position.

The chair illustrated in FIGS. 5 to 8 differs from those in FIGS. 1 to 4 only by the incorporation of a saddle part 28 in the seat part 3, wherein the saddle part 28 can pivot in relation to a base element of the seat part 3 about a pivot axis 29 directed transversely to the chair. This pivoting of the saddle part 28 is carried out synchronously with a change of the inclination alignment of the seat part 3 by means of an appropriate mechanism, which comprises an approximately L-shaped transmission element 30 (alternative: bow-shaped), which is connected, on the one hand, with the slide 27 of the backrest support 15. On the other hand, the saddle part 28 rests on a place at a distance from the pivot axis 29 on the transmission element 30 so that a torque generated by pressure of the saddle part 28 is supported by the transmission element 30.

This mechanism works by ensuring that the saddle part 28, which is arranged essentially flush inside a corresponding recess in the base element of the seat part 3 (pivot angle $\beta$: zero) with the seat part 3 in a basic inclination position (cf. FIGS. 5 and 6), remains in approximately horizontal alignment, when the inclination alignment of the seat part 3 is changed by elongating the telescopic section of the backrest support 15 running vertically into a seat surface falling away towards the front seat edge 8. In doing so, the pivot angle $\beta$ formed between the base element and the saddle part 28 increases as the inclination alignment of the seat part 3 continues to increase. In the same way, this pivot angle $\beta$ again reduces when the inclination alignment of the seat part 3 is changed by pushing together the telescopic section of the backrest support 15 towards the basic inclination position.

In the pivoted attitude compared with the base element, in which the saddle part 28, compared with the basic inclination position, also is arranged higher off the floor on which the chair is positioned, the saddle part 28 can serve as an alternative seat surface on which a user can support him-/herself while standing. This functionality allows the chair to be used as a standing seat.

The chairs illustrated in the drawings are formed as swivel chairs. Thus, in each case, the seat base 9 of the frame 1 is connected to a foot part 33, only partially illustrated, of the frame 1 by a fifth swivel joint 31 to rotate about an extending ninth swivel axis 32 aligned in a vertical, in fact practically vertical, direction of the chair.

REFERENCE LIST

1 frame
2 seat shell
3 seat part
4 backrest
5 first swivel joint
6 second swivel joint
7 third swivel joint
8 front seat edge
9 seat base
10 first swivel axis
11 second swivel axis
12 bearing pedestal
13 bearing bridge
14 swivel bearing pin
15 backrest support
16 third swivel axis
17 fourth swivel axis
18 backrest edge
19 fourth swivel joint
20 fifth swivel axis
21 rod
22 sixth swivel axis
23 lever
24 seventh swivel axis
25 eighth swivel axis
26 backrest support
27 slide
28 saddle part
29 pivot axis
30 transmission element
31 fifth swivel joint
32 ninth swivel axis
33 foot part

The invention claimed is:

1. Seating furniture product comprising:

a frame; and a support surface unit including a seat part and a backrest connected directly to the seat part, wherein the seat part is connected to the frame by means of a swivel joint allowing a rotation about a swivel axis aligned transversely to the seating furniture product and the backrest is connected to the frame by a fastening point movable to a plurality of fixed positions, each of said plurality of fixed positions being at a different distance from the swivel joint in terms of the vertical direction of the seating furniture product, such that moving the fastening point from one of said plurality of fixed positions to another of said plurality of fixed positions is accompanied by a change in the inclination alignment of the seat part.

2. Seating furniture product comprising:

a frame including a backrest base support and a slide; and a support surface unit including a seat part and a backrest connected directly to the seat part, wherein the seat part is connected to the frame by means of a swivel joint allowing a rotation about a swivel axis aligned transversely to the seating furniture product, and the backrest is connected to the frame by a fastening point provided by said slide, wherein the distance between the fastening point and the swivel joint can be changed in terms of the vertical direction of the seating furniture product by moving the slide along the backrest base support portion, and changing the distance between the fastening point and the swivel joint is accompanied by a change in the inclination alignment of the seat part.

3. Seating furniture product according to claim 2, wherein the fastening point can be fixed in position at different distances from the swivel joint.

4. Seating furniture product according to claim 2, including a locking mechanism to lock the movement of the slide in at least one locking position.

5. Seating furniture product according to claim 4, wherein moving the slide to a release position and positioning the fastening point at a maximum distance from the swivel joint locks the movement of the slide.

6. Seating furniture product according to claim 2, wherein the fastening point comprises a swivel joint allowing rotation about a swivel axis aligned transversely to the seating furniture product.

7. Seating furniture product according to claim 2, wherein the seat part has a saddle part which can swivel in relation to a base element of the seat part about a pivot axis aligned transversely to the seating furniture product.

8. Seating furniture product of claim 7 wherein the saddle part is arranged essentially flush inside a corresponding recess in the base element of the seat part.

9. Seating furniture product according to claim 7, including a mechanism, by means of which a pivot angle (β) between the base element of the seat part and the saddle part is increased as the distance between the fastening point and the swivel joint increases.

10. Seating furniture product of claim 9, wherein the mechanism retains the saddle part in substantial horizontal alignment, when the inclination alignment of the base element of the seat part is changed.

11. Seating furniture product according to claim 9, including a transmission element coupled with the fastening point and supporting the saddle part at a position at a distance from the pivot axis.

12. Seating furniture product according to claim 2, wherein the support surface unit is designed to be deformable and the fastening point comprises a swivel joint allowing rotation about a swivel axis aligned in a longitudinal direction of the seating furniture product.

13. Seating furniture product according to claim 2, wherein the fastening point is arranged centrally in relation to the transverse direction of the backrest.

14. Seating furniture product according to claim 2, wherein the frame has a seat base connected to the seat part by the swivel joint and a backrest support connected to the backrest by the fastening point, wherein the seat base and the backrest support are connected by a swivel joint allowing rotation about a swivel axis aligned transversely to the seating furniture product.

15. Seating furniture product according to claim 14, wherein the backrest support is adjustable in relation to the seat base between a first, upright attitude and a second, backward leaning attitude, wherein an angle (a) between the seat part and the backrest in the second attitude is greater than in the first attitude.

16. Seating furniture product according to claim 14, wherein the backrest support is adjustable in relation to the seat base between a first, upright attitude and a second, backward leaning attitude, wherein a re-adjustment between the two attitudes causes a front edge of the seat part to move in the vertical direction of the seating furniture product.

17. Seating furniture product according to claim 2, wherein the swivel joint allows rotation about a vertical swivel axis.

* * * * *